US005307897A

United States Patent [19]

Turner et al.

[11] Patent Number: 5,307,897

[45] Date of Patent: May 3, 1994

[54] SAFETY STANCHION FOR FALL PROTECTION SYSTEM

[75] Inventors: C. Rockwell Turner, Loveland; Steven P. Miller, Thornton, both of Colo.; Roger W. Gallagher, Scottsdale, Ark.; Barry A. Cole, Colchester, Conn.

[73] Assignee: LPR Construction Company, Loveland, Colo.

[21] Appl. No.: 978,922

[22] Filed: Nov. 19, 1992

[51] Int. Cl.[5] ..... B21F 27/00

[52] U.S. Cl. ..... 182/3; 182/113

[58] Field of Search ..... 182/3, 113; 256/59, 256/53, 65; 248/228, 499

[56] References Cited

U.S. PATENT DOCUMENTS

| | | | |
|---|---|---|---|
| 3,867,997 | 2/1975 | Hyslop, Jr. | 182/113 |
| 3,920,221 | 11/1975 | Berry et al. | 256/59 |
| 4,188,878 | 2/1980 | Kuhnau | 248/499 X |
| 4,195,806 | 4/1980 | Berry | 248/228 X |
| 4,909,483 | 3/1990 | van Herpen | 256/65 X |
| 5,029,670 | 7/1991 | Whitmer | 182/113 |

*Primary Examiner*—Alvin C. Chin-Shue

*Attorney, Agent, or Firm*—Chilton, Alix & Van Kirk

[57] ABSTRACT

A safety stanchion is adapted for mounting to a structural I-beam to tie off workers. The safety stanchion includes a post which extends at an oblique angle to the base. The base is secured to the I-beam by means of a ratchet lock mechanism which hooks around the I-beam and a pair of bolts which lock against the underside of the I-beam. The stanchion provides a fixed mounting point for a fall protection system for workers with integral strength to accept stresses caused by falling objects and/or persons.

19 Claims, 4 Drawing Sheets

SAFETY STANCHION FOR FALL PROTECTION SYSTEM

BACKGROUND OF THE INVENTION

This invention relates generally to fall protection systems for construction or maintenance workers. More particularly, the present invention relates to fall protection systems which employ stanchions or posts mounted to various members of a superstructure.

The protection of workers from falls during the erection of a steel superstructure has proved to be a difficult problem. For many construction projects, fall protection for workers during the initial stages is minimal or non-existent. The expense and difficulty of installing or using fall protection systems has proved to be an impediment to implementing fall protection even though life, safety and liability have become a matter of paramount concern. Accordingly, the protection of workers during the erection process has become the subject of increasing governmental regulation.

Most conventional protection systems to which the invention relates involve systems for tying off the worker to a cable which may be anchored and supported in a wide variety of ways. There are often few or no suitable anchoring points except at the feet of the worker which increases to the danger of tripping, increases fall distance, and decreases suitability. If there are vertical tie off points, a cable can be strung and the worker typically wears a harness or belt which connects with a cable. However, the cable is ordinarily located in the plane of the worker's walkway and thus a hinderance. No tie off point is easily tested on-site and few pre-engineered universally applicable systems are available. Conventional fall protections systems frequently do not provide a high level of protection, are not easily installed and commonly interfere with the construction process.

One conventional method to which the present invention relates is disclosed in U.S. Pat. No. 4,037,824 wherein a safety post for construction workers employs an angle structure having integral horizontal and vertical legs. The horizontal leg has a clamp which includes fixed and moveable tapered members for detachably gripping structural beams. The moveable member has a portion loosely encircling the horizontal leg with a fulcrum below and a screw structure operable from above to pivot and tighten a moveable member. The vertical member has a column which may optionally be height adjustable by telescoping separate lengths which terminate at the top in a pair of fixed arcuate horns. The ends of the horns are inwardly turned and overlapping for retaining a safety cable therebetween. The workmen are connected to the safety cable by auxiliary safety lines which travel along the cable. The latter described vertical posts extend at 90° to the beam and are disposed adjacent to the vertical plane of the beam. The disclosed post may not provide sufficient integral strength to arrest a fall, unless substantial additional anchoring support for the cable is provided.

A number of other references which disclose fall protection structures systems to which the invention relates are identified below.

| Patentee | Patent No. |
|---|---|
| Jackson | 3,237,717 |

-continued

| Patentee | Patent No. |
|---|---|
| Leduc | 4,116,305 |
| Woolslayer et al | 4,171,032 |
| Landry | 4,243,118 |
| Tupper et al | 4,313,236 |

West German Publication DE 3023489 published on Jul. 1, 1982 discloses a fall protection system wherein a bracing wire is suspended between double supports fixed to a beam.

SUMMARY OF THE INVENTION

Briefly stated, the invention in a preferred form is a safety stanchion for mounting to a structural I-beam. The stanchion includes a base which has a platform. The base has a lateral slot which is dimensioned to receive the flange of an H-beam or an I-beam hereinafter collectively termed I-beam. Because the post fits over the flange on the side of the beam, it is universally adaptable to most beams in use today. The stanchion may also be used on trusses and bar stock of sufficient size and strength. The post extends from the platform at an oblique angle. An eye or other means at the top of the post is provided for mounting a safety cable. The base is locked to the I-beam by one or more bolts which are tightened against the I-beam. In addition, a second locking mechanism has a universally adjustable strap and a hook which engages the outer portion of the I-beam and is secured by means of a ratchet lock.

In a preferred embodiment, the base is a heavy duty steel (or other structural metal) member having a pair of parallel plate-like extensions which define the lateral slot. The lower portion of the base terminates so that the medial panel portion of the I-beam and the outer end of the I-beam flange may be engaged against the base. Two lock bolts are threaded to the base for engaging against the I-beam flange. The post preferably has a diamond section with an axis through opposite vertices being parallel to the sides of the base. In the preferred embodiment, the ratchet lock is mounted to the post.

A fall protection system optimally and in its simplest form comprises two safety stanchions which are mounted to the superstructure. If necessary, a stanchion may be used at one or more intermediate points of a long span of safety cable. The safety cable is mounted to the stanchions. One or more lifelines are connected to the safety cable. The system can be hoisted into place for immediate use and installed on a new piece of steel by the receiving workers. The stanchion is light enough to be installed by one worker.

An object of the invention is to provide a new and improved safety stanchion for providing fall protection for workers during the erection of a superstructure.

Another object of the invention is to provide a new and improved safety stanchion and fall protection system which provides a high level of fall protection without interfering with the movement of the worker during the erection process.

A further object of the invention is to provide a new and improved safety stanchion which is relatively easy to install and remove, and is lighter and less complex than others available.

A further object of the invention is to provide a stanchion with sufficient integral strength to withstand a fall in the system without a cable tie off point on the structure outside the stanchion.

A yet further object of the invention is to provide a pre-engineered universally applicable fall protection system without requiring field testing.

Other objects and advantages of the invention will become apparent from the specification and the drawings.

DETAILED DESCRIPTION OF THE PREFERRED EMBODIMENT

Figure 1:
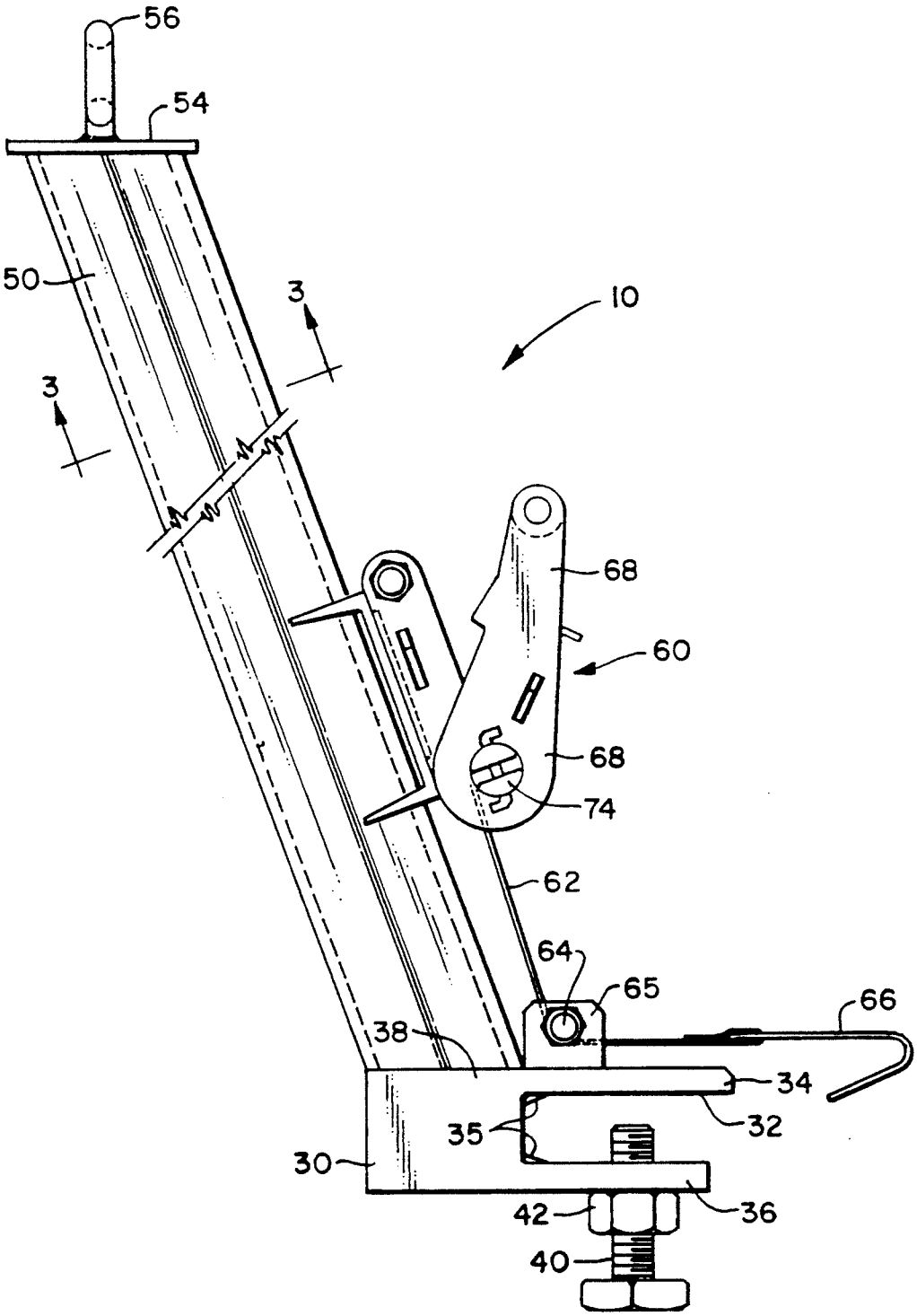
FIG. 1 is a side elevational view, partly broken away and partly in phantom, of a safety stanchion in accordance with the present invention.
Figure 2:
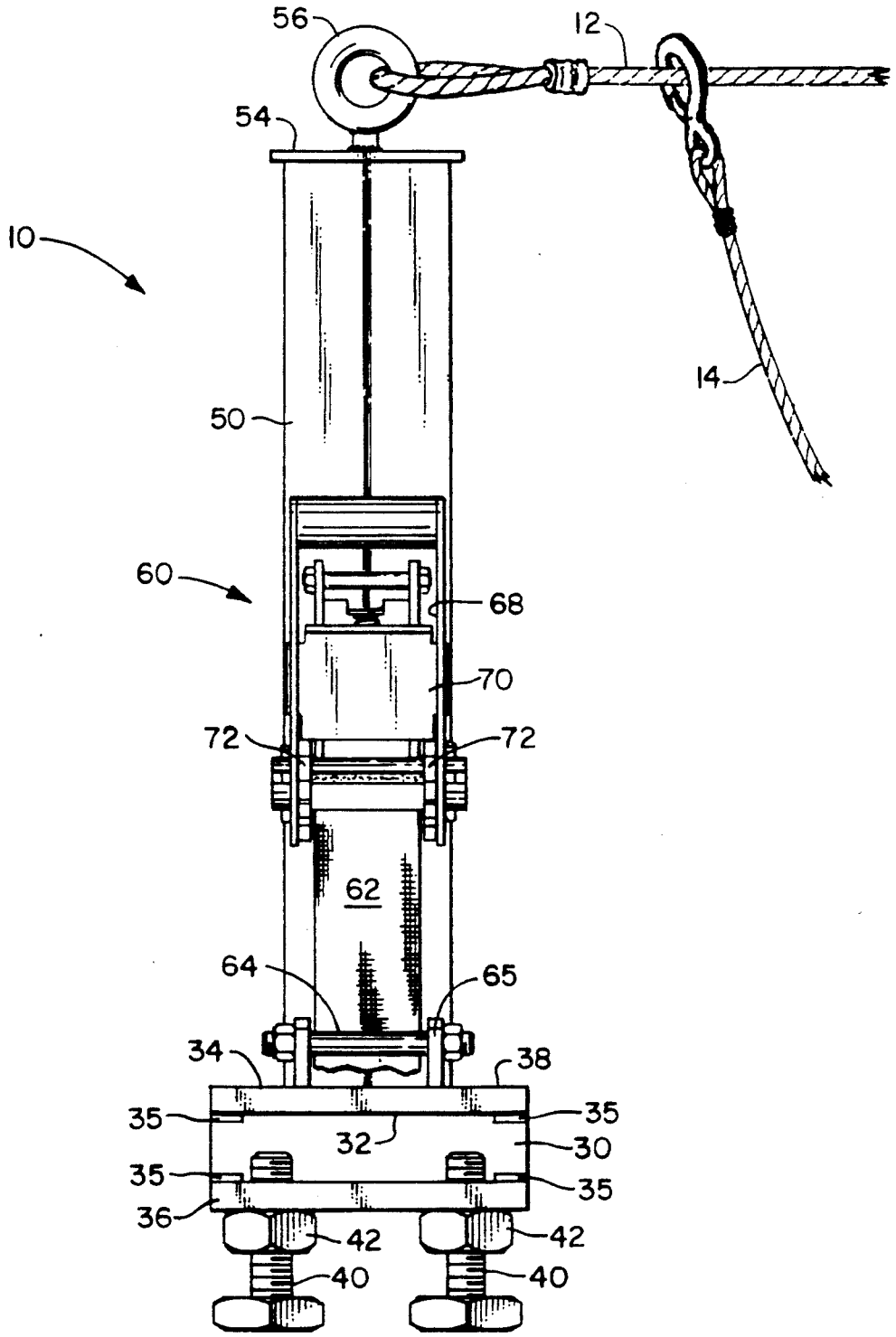
FIG. 2 is a frontal view, partly broken away, of the safety stanchion of FIG. 1; and further illustrating a portion of a fall protection system provided by the present invention.

With reference to the drawings wherein like numerals represent like parts throughout the figures, a safety stanchion in accordance with the present invention is generally designated by the numeral 10. With reference to FIG. 2, safety stanchion 10 is adapted to provide a vertical support for suspending a safety cable 12. The safety cable 12 connects via a safety line 14 with a belt or harness (not illustrated) worn by a worker during the erection of a superstructure for a bridge or a similar structure. The stanchion mounts to a structural H-beam or I-beam 20 which is prototypically illustrated in FIG. 4. As used herein, "I-beam" refers to an I-beam or an H-beam. The I-beam 20 typically has an upper flange 22, a medial support panel 24 and a lower flange 26. The panel 24 may be solid or composed of truss components. For a given project, several safety stanchions 10 may be employed.

The safety stanchion 10 has a sturdy base 30 which is preferably constructed from steel or other structural metal. The base has a lateral slot 32 which is defined by an upper plate 34 and a lower plate 36. The base 30 may be an integral member which is cut to form the plates 34 and 36. Weldments 35 (FIG. 2) are located at the rear corners of the slot for reinforcement and to prevent plate separation. The lateral slot is dimensioned to receive the upper flange 22 of most, if not all, common sizes of a structural I-beam so that the edge of the flange engages the rear surface of the slot. The lower plate 36 does not extend the same lateral dimension as the upper plate 34 so that on the smallest beams, the lower plate 36 does not engage or produce interference caused by contact with the medial support member 24. The top surface of the upper plate 34 forms a platform 38 and is beveled at its front edge to accommodate the engagement by a strap as described below.

Figure 4:
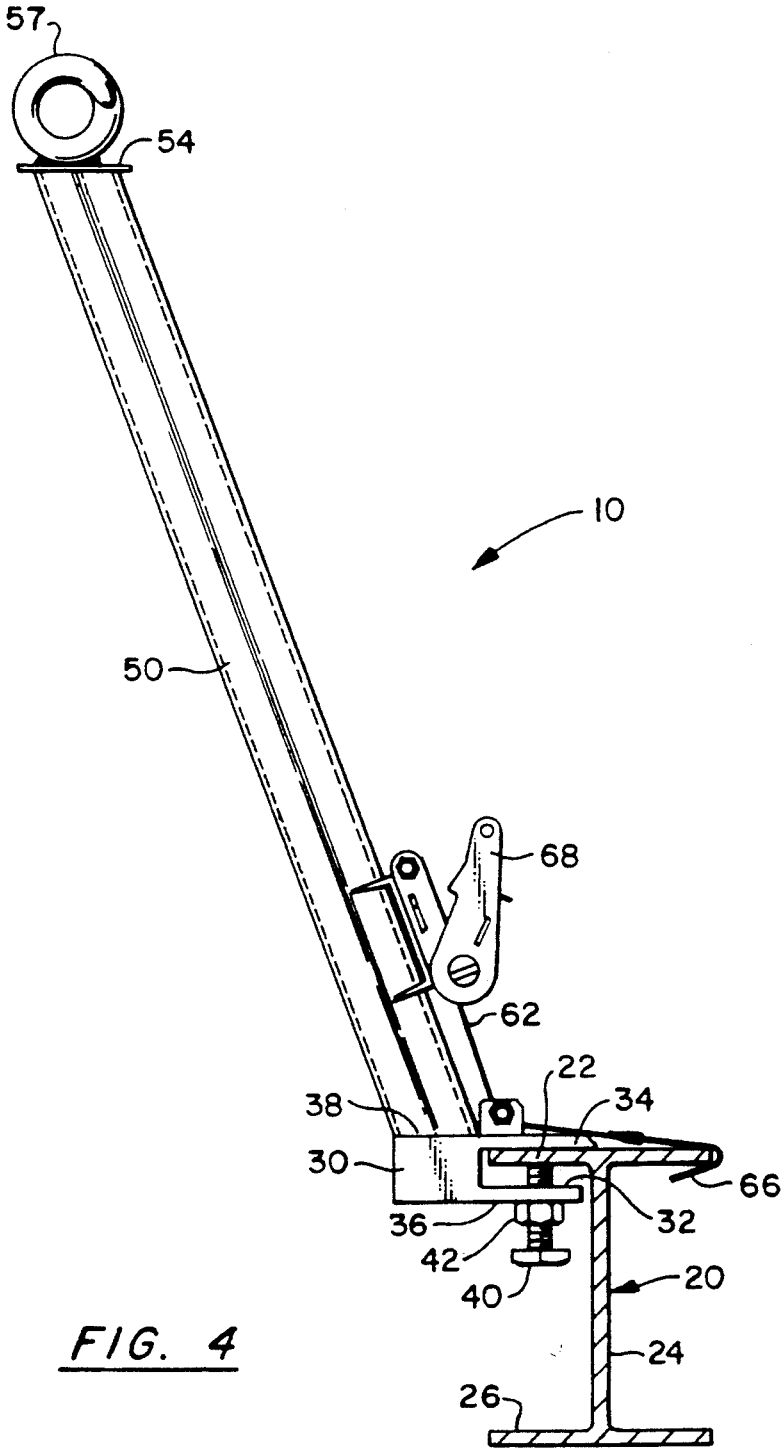
FIG. 4 is a side elevational view, partly in phantom, of a modified embodiment the safety stanchion of FIG. 1 mounted to a structural I-beam illustrated in section.

A pair of hex head structural lock bolts 40 thread into the base from the bottom portion of the base. The lock bolts 40 may be threadably mounted by a pair of transversely spaced threaded nuts 42 which are welded to the underside of the lower plate. In an alternate embodiment, the lower plate is threaded omitting the threaded nuts 42. The bolts are threadably tightened so that the ends engage the underside of the I-beam flange 22 thereby securely anchoring the base 30 to the I-beam 20, as illustrated in FIG. 4. For some embodiments, only one bolt 40 is employed. Other captive lock devices can also be employed.

Figure 3:
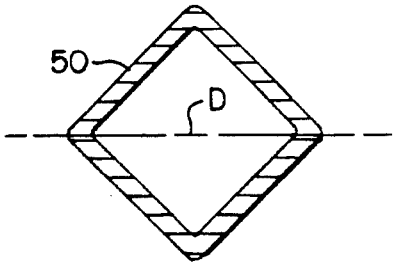
FIG. 3 is a sectional view of the safety stanchion of FIG. 1 taken along the line 3—3 thereof.

A post 50 extends upwardly from the platform 38 at an oblique angle of approximately 19°. The post 50 is made from tubular steel having a square or diamond-shaped cross section (FIG. 3). The post 50 is mounted to the platform 38 so that a diagonal D through opposing vertices of the tubular post extends laterally and generally centrally between the transversely spaced sides of the base. A cap 54 is welded at the upper terminus of the post. A hook or eye bolt 56 is welded to the cap. The eye bolt 56 receivably mounts the safety cable 12 for the fall protection system. Alternately, the end of the post may be drilled or compressed in a die and drilled, thus omitting the cap and eye bolt 56. It will be appreciated that the tubular construction and the diamond-shaped disposition of the post enhances the structural integrity of the post and the resistance to deformation should a substantial load be suddenly exerted on the post due to the fall of a worker.

Figure 5:
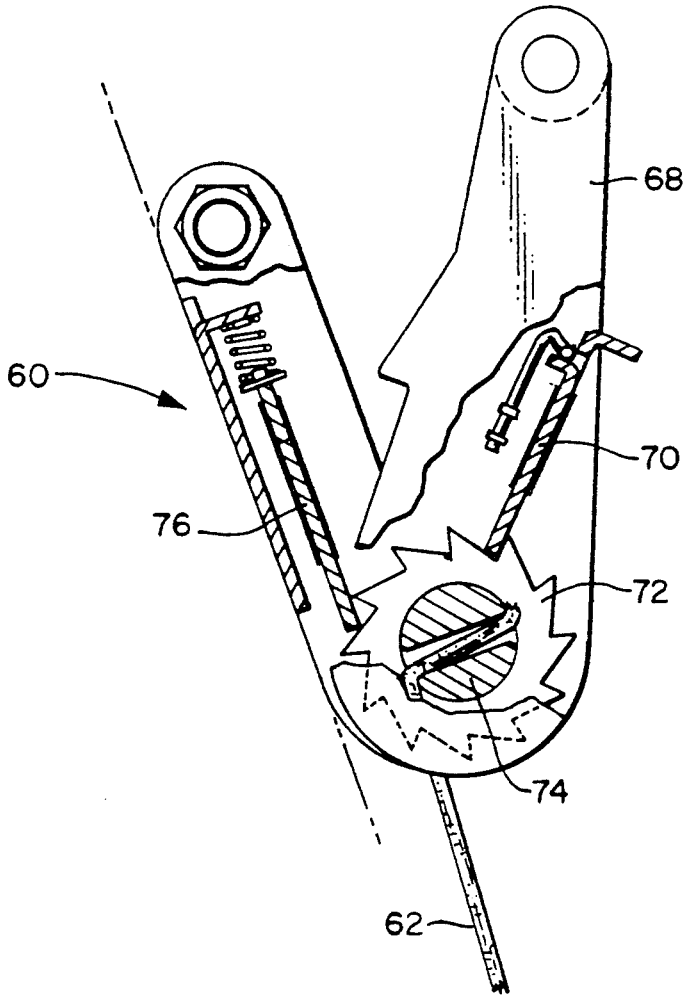
FIG. 5 is an enlarged fragmentary side view, partly in section and partly broken away, of the safety stanchion of FIG. 1.

A ratchet buckle or winch lock 60 is mounted to the front of the post. The ratchet lock employs a strap 62 which is passed under a transverse bar 64 suspended above the platform 38. A bracket 65 mounts opposite end portions of the bar 64. The strap 62 may be manufactured from a polyester or nylon webbing material rated for at least 10,000 lbs. and having a width of 2 inches and a length on the order of 3 feet. The distal end of the strap securely connects with a plate-like hook 66 which is dimensioned to grasp the extreme upper flange portion of the I-beam to provide a second securement of the stanchion with the I-beam. With additional reference to FIG. 5, the ratchet lock includes a bifurcated ratchet handle 68 which carries a spring loaded one-way catch 70. A pair of transversely spaced ratchet gears 72 are fixed relative to a reel shaft 74 for the strap 62. The catch engages opposed teeth of the ratchet gears 72 to rotate the reel shaft 74 for tightening the 62 strap upon forwardly pivoting the handle 68. The strap 62 engages in taut angular fashion around the bar 64. Upon rearward pivot or release of the handle, the catch 70 rides over the ratchet teeth. A spring-loaded brake 76 prevents reverse rotation of the reel. The lock is released by manually upwardly displacing the catch 70. Preferably, the ratchets are rated at 10,000 lbs. or greater.

The fall protection system provided by the stanchions in its simplest form comprises two of the stanchions 10 mounted in a linear array along the superstructure and spaced 20–60 feet apart. The safety cable 12 is suspended from each of the stanchions and is anchored to each of the stanchions. An energy absorber (not illustrated) is also preferably incorporated into the safety cable line. Lifelines 14 for each of the workers are then connected for travel along the safety cable. Lifelines are preferably as short as practical and preferably less than 6 feet. The lifelines are preferably fitted with an integral shock absorber as well.

The stanchions 10 and the safety cable 12 provide a cable which is preferably suspended at or above the waist of the worker to provide an anchoring system for the worker should the worker fall, as well as a handrail-type guide for the worker traversing across the structural framework. The oblique angle of the post allows the safety cable to be positioned away from the vertical plane of the beam to provide a more effectively positioned handrail and also allow more facile movement for a worker traversing the beam. In a preferred embodiment, the stanchions 10 are spaced at approximately 30–40 foot intervals along the superstructure. For longer spans, stanchions may be used as intermediate support structures for the safety cable in which event a pair of cooperating horns or catches 57 (FIG. 4) is mounted at the top of the post 50 rather than eye bolt 56.

For some applications, such as a roof truss, the stanchions may be inverted and suspended from the bottom flange of the truss.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety stanchion for mounting to a structural I-beam or the like comprising:

base means for forming a base having a platform and slot means for defining a lateral slot;

post means comprising a post extending from said platform at an oblique angle thereto;

cable mounting means for mounting a cable to said post means;

first lock means comprising at least one bolt mounted to said base means and variably positionably in said slot for locking said base means to a portion of said beam received in said slot; and second lock means independent of said first lock means, said second lock means mounted to said post for locking said base means to a received beam by engaging a portion of said beam not received in said slot, said second lock means comprises a ratchet lock mechanism comprising a strap.

2. The safety stanchion of claim 1 wherein said base comprises a pair of parallel substrates which at least partially define said lateral slot.

3. The safety stanchion of claim 2 wherein one of said substrates is an upper plate at least partially defining said platform, and said other substrate is a lower plate, said lower plate extending laterally a distance less than said upper plate.

4. The safety stanchion of claim 1 wherein said first lock means comprises a bolt threadably mounted to said base and having a distal end which is threadably positionable in said slot.

5. The safety stanchion of claim 4 further comprising a second bolt threadably mounted to said base means and having a distal end threadably positionable in said slot.

6. The safety stanchion of claim 1 wherein said post has a diamond-shaped cross section with opposed vertices.

7. The safety stanchion of claim 6 wherein said post is generally centrally positioned between opposing sides of said platform and the vertices of said post are generally oriented along a lateral plane.

8. The safety stanchion of claim 1 further comprising a hook mounted to the distal end of said strap.

9. The safety stanchion of claim 1 wherein said strap wraps against a bar suspended above said platform.

10. The safety stanchion of claim 1 wherein said cable mounting means comprises an eye mounted to the top of said post.

11. A safety stanchion for mounting to a structural I-beam or the like comprising:

base means for forming abase having a platform and slot means for defining a lateral slot;

post means comprising a post extending from said platform at an oblique angle thereto;

cable mounting means mounted to said post means for mounting a cable thereto;

first lock means comprising at least one bolt mounted to said base means and variably positionable in said slot for locking said base means to a portion of said beam received in said slot; and second lock means independent of said first lock means, said second lock means mounted to said post and comprising a flexible member and a hook for locking said base means to a received beam by engaging said hook to a portion of said beam not received in said slot and tightening said flexible member.

12. The safety stanchion of claim 11 wherein said base comprises a pair of parallel substrates which at least partially define said lateral slot.

13. The safety stanchion of claim 12 wherein one of said substrates is an upper plate at least partially defining said platform, and said other substrate is a lower plate, said lower plate extending laterally a distance less than said upper plate.

14. The safety stanchion of claim 11 wherein said flexible member is a strap and said second lock means further comprises a rotatable shaft, said strap being windable on said shaft and a ratchet lock means for tightening said strap by rotating said shaft.

15. A fall protection installation comprising: an I-beam having a medial structure and flange perpendiclarly extending from opposed sides of said medial structure;

base means for forming a base having a platform and slot means for defining a lateral slot dimensioned to receive a portion of said flange;

post means comprising a post extending from said platform;

cable mounting means for mounting a cable to said post means;

first lock means comprising at least one bolt mounted to said base means for locking said base means to said flange portion received in said slot; and second lock means independent of said first lock means, said second lock means mounted to said post and comprising a flexible member and a hood engaged to a flange portion opposite said received flange portion for locking said base means to said beam.

16. The fall protection installation of claim 15 wherein said base comprises a pair of parallel substrates which at least partially define said lateral slot, one said substrate engaging said flange in generally surface-to-surface relationship.

17. The fall protection installation of claim 16 wherein one of said substrates is an upper plate at least partially defining said platform, and said other substrate is a lower plate, said lower plate extending laterally a distance less than said upper plate.

18. The fall protection installation of claim 16 wherein said first lock means comprises two bolts each threadably mounted to said base and having a distal end which is threadably positionable in said slot and engageable against said upper flange.

19. The fall protection installation of claim 16 wherein said second lock means comprises a strap and a hook connected to said strap and ratchet drive means for variably fixing the effective free length of said strap.

* * * * *

UNITED STATES PATENT AND TRADEMARK OFFICE

CERTIFICATE OF CORRECTION

PATENT NO. : 5,307,897
DATED : May 3, 1994
INVENTOR(S) : C. Rockwell Turner et al It is certified that error appears in the above-indentified patent and that said Letters Patent is hereby corrected as shown below:

1. Claim 1, column 5, line 32, change "positionably" to --positionable--.

2. Claim 11, column 6, line 3, change "abase" to --a base--.

3. Claim 15, column 6, line 46, change "hood" to --hook--.

Signed and Sealed this

Eighth Day of November, 1994

*Attest:*

Bruce Lehman

BRUCE LEHMAN

*Attesting Officer*

*Commissioner of Patents and Trademarks*